US006419020B1

(12) United States Patent
Spingath

(10) Patent No.: US 6,419,020 B1
(45) Date of Patent: Jul. 16, 2002

(54) HYDRAULIC DRILLING METHOD AND SYSTEM FOR FORMING RADIAL DRAIN HOLES IN UNDERGROUND OIL AND GAS BEARING FORMATIONS

(76) Inventor: Ben Spingath, 1104 River Oaks Dr., Bakersfield, CA (US) 93309-2859

( * ) Notice: Subject to any disclaimer, the term of this patent is extended or adjusted under 35 U.S.C. 154(b) by 0 days.

(21) Appl. No.: 09/841,202

(22) Filed: Apr. 24, 2001

(51) Int. Cl.[7] ..... E21B 7/08

(52) U.S. Cl. ..... 166/313; 166/50; 175/62; 175/75

(58) Field of Search ..... 166/313, 50; 175/61, 175/62, 75, 80, 89

(56) References Cited

U.S. PATENT DOCUMENTS

| | | | | |
|---|---|---|---|---|
| 3,965,982 A | | 6/1976 | Medlin | 166/249 |
| 4,022,279 A | | 5/1977 | Driver | 166/271 |
| 4,386,665 A | | 6/1983 | Dellinger | 175/61 |
| 4,431,069 A | | 2/1984 | Dickinson et al. | 175/61 |
| 4,434,849 A | | 3/1984 | Allen | 166/252 |
| 4,444,265 A | | 4/1984 | Schmidt | 166/295 |
| 4,527,639 A | | 7/1985 | Dickinson et al. | 175/61 |
| 4,605,076 A | | 8/1986 | Goodhart | 175/61 |
| 5,029,641 A | | 7/1991 | Stagg | 166/50 |
| 5,074,360 A | | 12/1991 | Guinn | 166/281 |
| 5,373,906 A | * | 12/1994 | Braddick | 175/67 |
| 5,413,184 A | * | 5/1995 | Landers | 175/62 |
| 5,435,400 A | * | 7/1995 | Smith | 175/61 |
| 5,853,056 A | * | 12/1998 | Landers | 175/424 |
| 6,125,949 A | * | 10/2000 | Landers | 175/62 |

* cited by examiner

*Primary Examiner*—William Neuder
(74) *Attorney, Agent, or Firm*—Dennis W. Beech

(57) ABSTRACT

The hydraulic drilling method and system uses a tube bending tool attached at the down hole end of a pipe or stringer to direct a fluid tube in a generally horizontal direction from a generally vertical gas or oil well. The bending tool is attached to a compression set tubing anchor, lowered into the well at the end of a pipe or stringer and anchored at the desired depth in the conventional manner. A fluid tube having a jet nozzle end is lowered to the bending tool and slidably inserted in a bending channel therein. Hydraulic cutting fluid under pressure is then applied to the pipe and fluid tube to urge the fluid tube through the bending tool to exit horizontally for boring a drain hole in the surrounding underground formation. Once the drain hole is formed the fluid tube is removed. Additional drain holes may be formed by rotating the bending tool radially in the well and inserting a new fluid tube with jet nozzle then repeating the cutting fluid drilling. With this method several radial drain holes may be formed at an intermediate level of a well for recovery of oil or gas from formations bypassed in the original well drilling.

22 Claims, 5 Drawing Sheets

HYDRAULIC DRILLING METHOD AND SYSTEM FOR FORMING RADIAL DRAIN HOLES IN UNDERGROUND OIL AND GAS BEARING FORMATIONS

BACKGROUND OF INVENTION

1. Field of the Invention.

This invention relates to devices and systems that are used to form radial drain holes relative to a generally vertical oil or gas well hole. The new system and method includes a tube bending tool lowered into a well casing to the desired depth to create radial drain holes. Hydraulic fluid tubing is then passed through the tool to direct the hydraulic fluid tubing or piston in a radial direction for use of hydraulic or jet fluid pressure to drill drain holes.

2. Description of Related Art.

Various devices, systems and methods have been disclosed in related art which may be used to form radial bore holes from an existing oil or gas well hole. These devices normally use rotary driven bits, cutting tools and the like to cut through the oil or gas bearing underground formation of interest. These systems essentially use motor driven mechanical cutting blades, bits and the like to form a borehole.

There are also hydraulic fluid or jet pressure drilling systems for creating boreholes. An example of such a system is that disclosed in U.S. Pat. No. 4,527,639, Issued Jul. 9, 1985. This invention includes use of hydraulic fluid pressure to drill both vertical and horizontal bore holes. The disclosures include a whipstock for bending a piston/drilling tube having a head for directing the pressurized cutting fluid. When the bore hole has been created the tube remains in the bore hole to be used to introduce fluid, which may be at an elevated temperature, to create pressure in an oil or gas bearing formation to facilitate recovery of oil or gas through an existing well structure.

The present invention uses coiled hydraulic fluid tubing with a jet nozzle, at its forwarded end the combination also called a piston, to conduct cutting fluid under pressure to the desired location to create a borehole. The tubing is passed through a tube bending tool retained at a specified depth in an oil or gas well casing. The fluid pressure of the cutting fluid forces the tubing and jet nozzle into the underground formation thereby cutting or boring a drain hole radially from the existing well casing. The tube and jet nozzle are then extracted from the drain hole. The tube bending tool is then rotated in the well casing and tubing with jet spray is again used to form another radial drain hole using a new tube and jet spray. In this manner a plurality of drain holes may be formed radially from an existing well casing to extract oil or gas from underground formations that were not producing zones for the original well formation.

SUMMARY OF THE INVENTION

One object of the present invention is recovery of oil or gas from zones of underground formations, which were not tapped or were bypassed when the original well was formed in favor of much larger production formations. Another object is an improved tube bending tool for use with hydraulic fluid tubing. A further object is an improved method of producing a plurality of radial bore or drain holes emanating from an existing well casing.

In accordance with the description presented herein, other objectives of this invention will become apparent when the description and drawings are reviewed.

DESCRIPTION OF THE PREFERRED EMBODIMENT

The following detailed description is the best currently contemplated modes for carrying out the invention. The description is not to be taken in a limiting sense, but is made merely for the purpose of illustrating the general principles of the invention.

A tube bending tool with a hook shape channel is formed with an outside diameter suitable for lowering into an existing oil or gas well casing. The bending tool is attached to a compression set tubing anchor that is in turn connected to pipe to form a work stringer to be lowered into the well in the conventional manner. When the bending tool is at the desired depth the anchor is engaged with the well casing and 1.00 inch outside diameter hydraulic fluid tubing having a jet nozzle on the forward end is fed into the pipe to the bending tool. Hydraulic cutting fluid under pressure is then applied to the fluid tubing to force the jet nozzle and tubing through the bending tool to be directed radially into the surrounding underground formation. Once the drain hole has been drilled the tubing and jet nozzle are extracted from the pipe and discarded. Other radial drain holes angularly separated may be formed in the same manner by first rotating the bending tool in the well casing.

Figure 1:
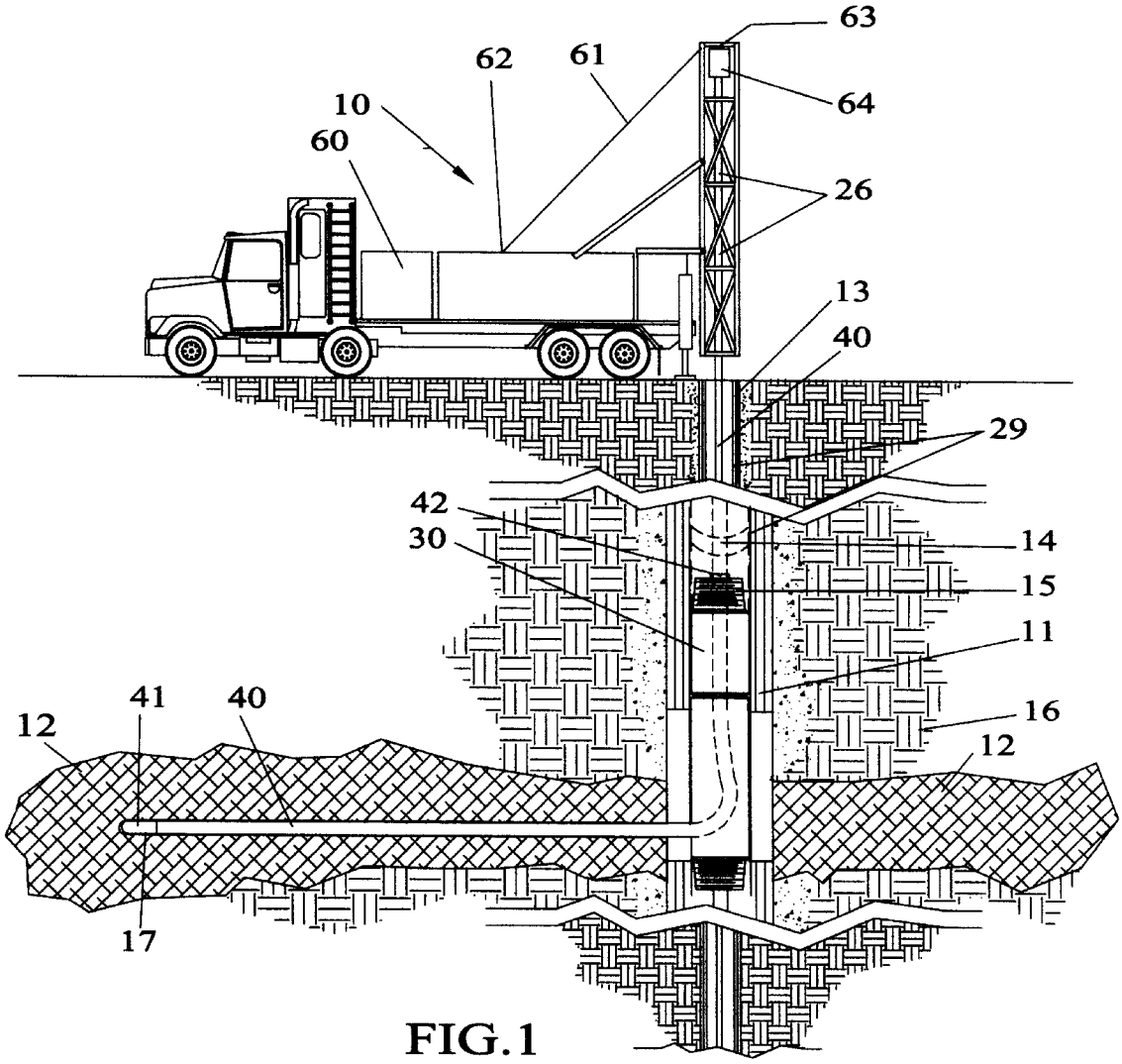
FIG. 1 illustrates a side elevation view, partially in section, of a conventional oil or gas well with an intermediate well casing chamber having radial drain holes extending therefrom.

Referring to FIG. 1 conventional oil or gas well (10) has a well casing (11) fixed in an underground gas or oil bearing formation (12). A stringer or work string (29) including pipe (13) has been lowered into the well casing (11) and has been retained in place by a compression set tubing anchor (14). Below the anchor (14) a section of pipe (13) has a tube bending tool (30) attached and located in cavity (16). A hydraulic fluid tube (40) with jet nozzle (41) passes through the pipe (13) and bending tool (30) to penetrate the underground formation (12) to create radial drain hole (17). The drain hole (17) is formed by the pressure of a hydraulic cutting fluid force passed through tube (40) to exit jet nozzle (41). The fluid pressure urges the tube (40) and nozzle (41) through the formation (12).

As each drain hole (17) is created the tube (40) and nozzle (41) are extracted from the pipe (13) and discarded. The anchor (14) is then loosened and the bending tool (30)

rotated angularly to a new radial position. A tube (40) with nozzle (41) is again lowered through the pipe (13) at the wellhead to descend under the force of gravity to reach the bending tool (30). Hydraulic cutting fluid is again introduced into the tube (40) to move the tube (40) and nozzle (41) through the bending tool (30) and into the underground formation (12) to create a radial drain hole (17). This process may be repeated to create a desired number of drain holes (17) at a specified depth.

Figure 3:
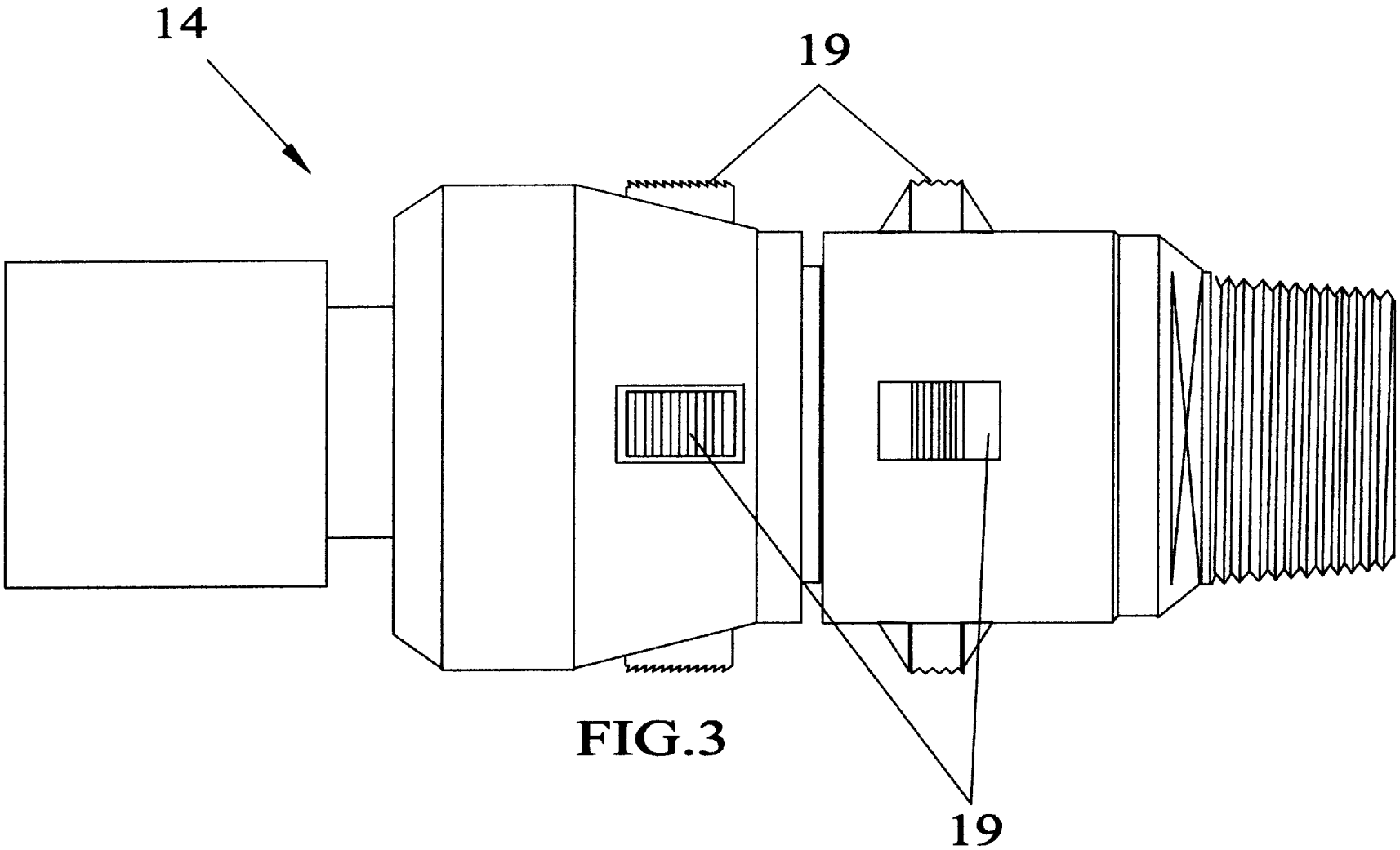
FIG. 3 illustrates an elevation view of a tubing anchor.
Figure 4:
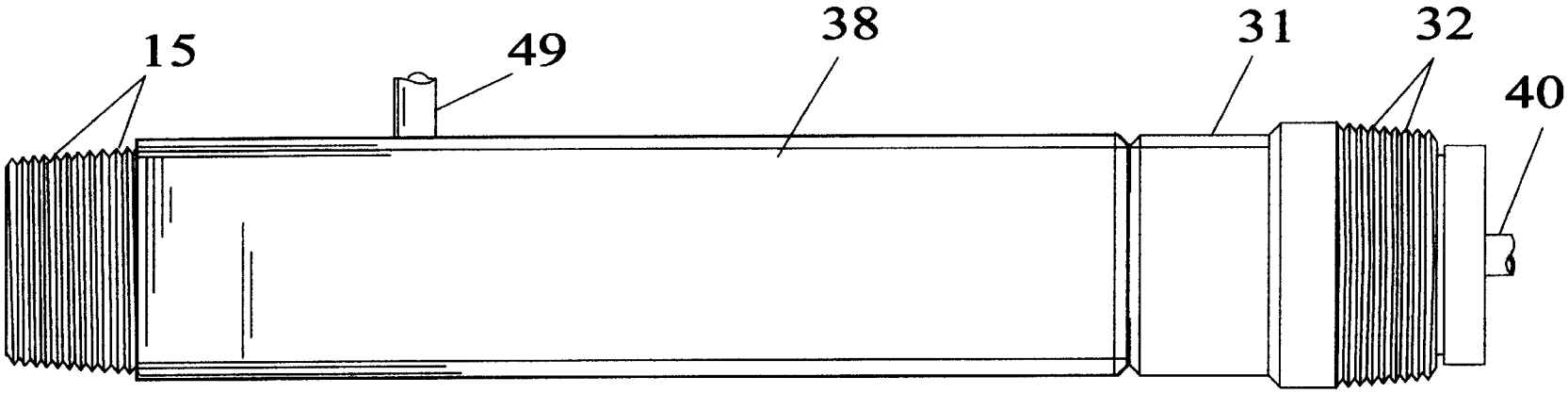
FIG. 4 illustrates a side view of the tube bending tool with a section of hydraulic tubing therein.
Figure 6:
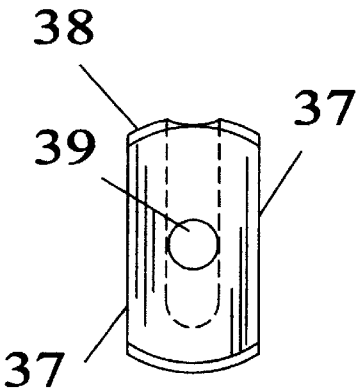
FIG. 6 illustrates an end view of the tube bending element.
Figure 5:
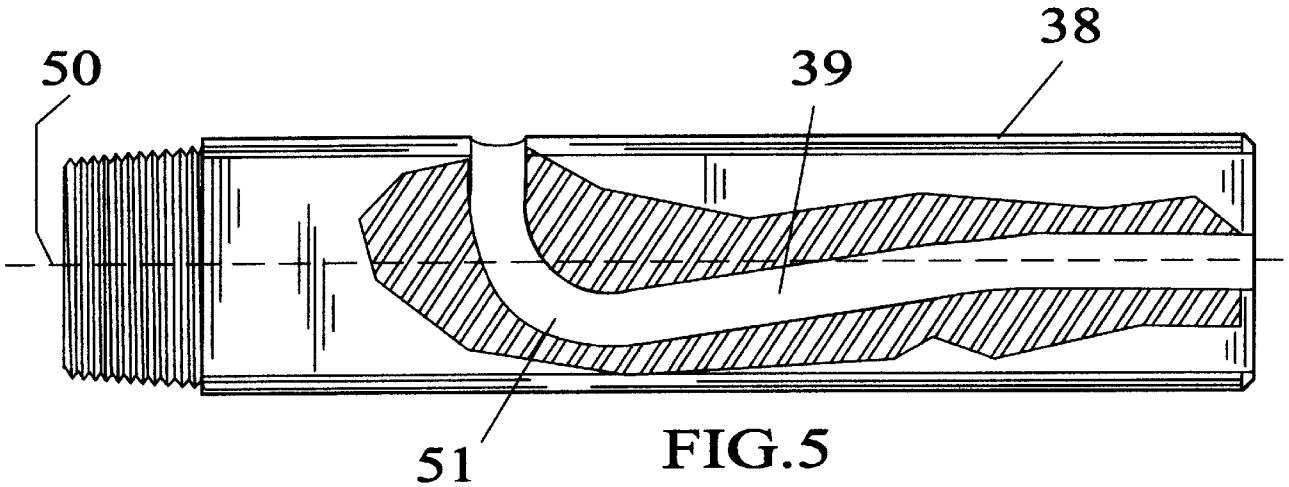
FIG. 5 illustrates a side cross sectional view of the tube bending element.
Figure 7:
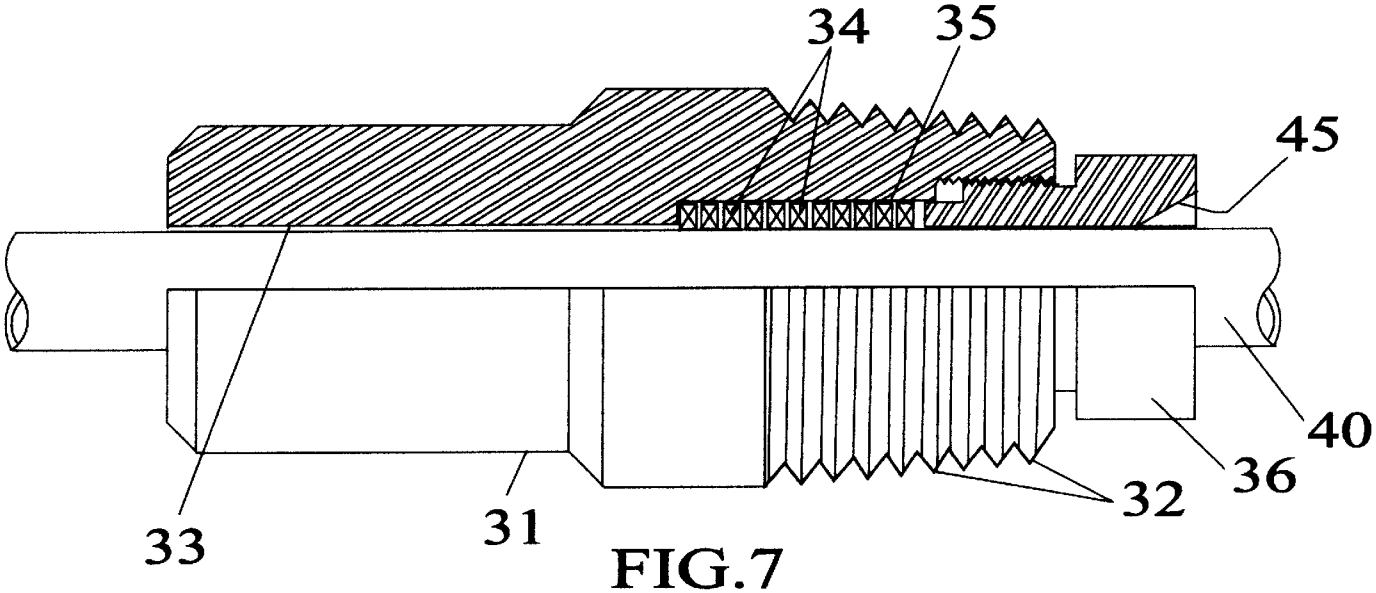
FIG. 7 illustrates a side partial cross sectional view of the attachment element.
Figure 9:
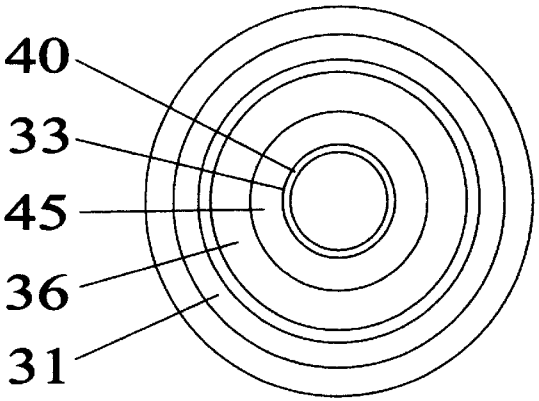
FIG. 9 illustrates a top end view of the attachment element.
Figure 8:
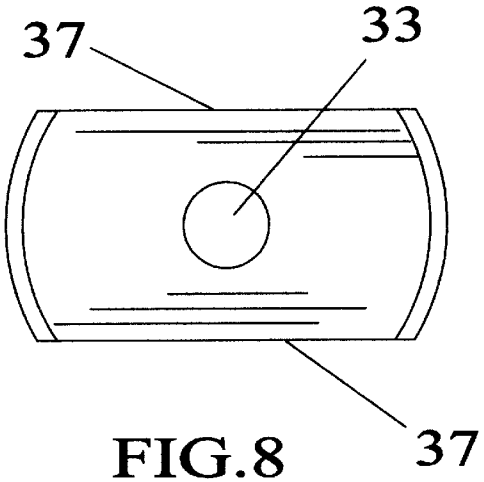
FIG. 8 illustrates a bottom end view of the attachment element.

Referring to FIGS. 1 and 3, the compression set tubing anchor (14) may be of any suitable type such as the BAKER OIL TOOL anchor. The anchor (14) is engaged with the well casing (11) by turning the pipe (13) one half turn to the right. This releases the tooth segments or slip elements (19) such that when the pipe (13) is set down six inches, the anchor (14) engages the well casing (11) thereby supporting the pipe (13) therein.

In order to properly locate the producing zone of an underground formation (12) a survey of the formation should be performed as commonly understood. Then the existing well casing (11) should be milled and cavity (16) formed at the desired depth. Alternatively, the nozzle (41) may be used to cut through the well casing (11) by use of a proper composition cutting fluid.

In a typical drilling operation the bending tool (30), anchor (14) and pipe (13) are lowered into the well (10) using conventional oil or gas well handling equipment. Once the equipment is deployed all fittings and equipment are pressure tested to insure pressure integrity and workplace integrity. The hydraulic cutting fluid is then pumped into the pipe (13) and tube (40) to force the movement and cutting action of the tube (40) and nozzle (41).

Figure 2:
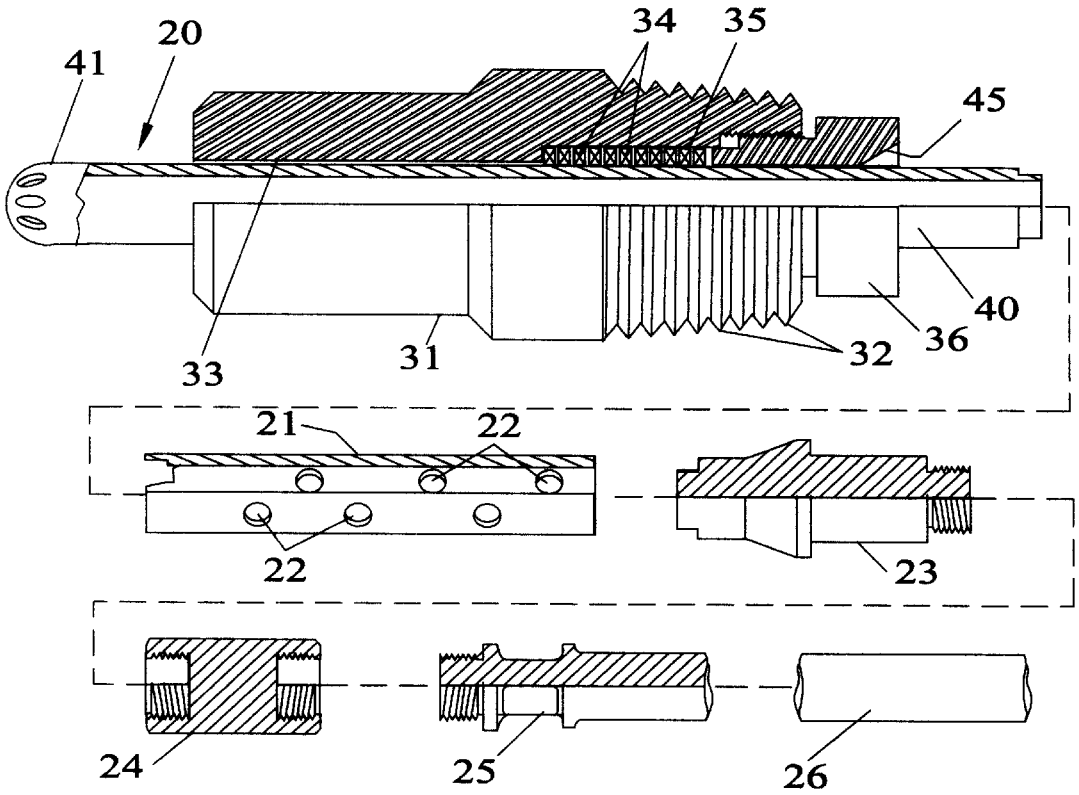
FIG. 2 illustrates an exploded view of the work string including the tube bending tool.
Figure 2A:
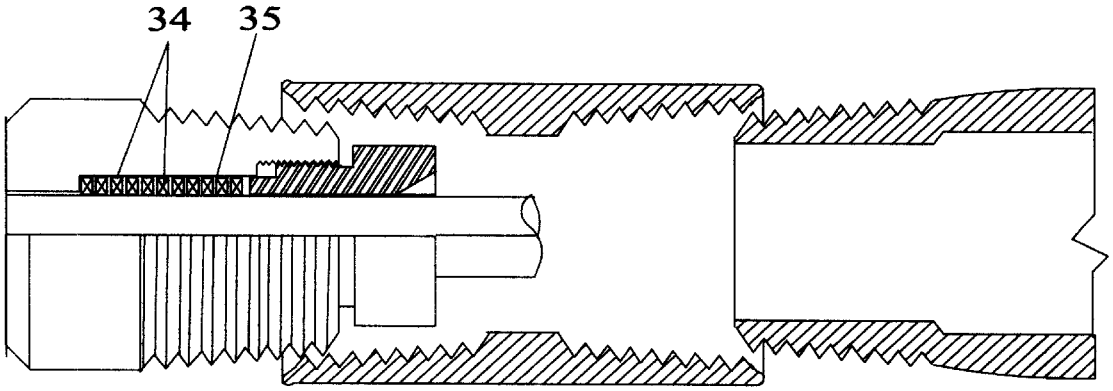
FIG. 2A illustrates a side cross-section view of the work string pipe and coupling.

Referring to FIGS. 1 through 2A, the tubing (40) is formed in precut lengths for the intended operation rather than using a continuous coil tube deployed from tube handling equipment. It has been found that 30 to 60 foot lengths, depending on the height or work space in the derrick, of 1.00 inch OD, outside diameter, tubing works well. A jet nozzle (41) is formed at one end of the tube (40) with the combination forming a piston (20). Opposite the jet nozzle (41) the tube (40) is attached to a crossover element (21) that allows entry of cutting fluid under pressure into the piston (20). The crossover element has three holes (22) formed therein, which are offset relative to each other. For a 1.00 inch OD crossover element (21) holes (22) of approximately 0.375 inch diameter are preferable. Other configurations of apertures may be used such as rectangular openings and the like. The crossover element (21) is hollow for a portion of its length at the end attached to the piston (20) and generally solid at the end opposite.

The crossover element (21) opposite the piston (20) is attached to a stop ring (23). The stop ring (23) is shaped to seat on the cap (36) or gland nut of the tube bending tool (30) to stop the piston (20) movement in the formation (13) at the predetermined length. The stop ring (23) is attached by a rod coupling fitting (24) to sucker rods (25). A sufficient number of sucker rods (25) are attached end to end such that when a polished rod (26) is attached at the wellhead the entire piston (20) string (27) can be controlled by handling equipment at the surface as the piston (20) penetrates the underground formation (13) and is removed therefrom.

At the surface the operator uses gauges that record string weight and pump pressure to control the movement of the piston (20) through the bending tool (30) and the underground formation (12). The operator may thus lessen the possibility that the string (27) will compress itself resulting in corkscrewed or bent tubing or sucker rods in the formation or above the tube bending tool. The string (27) is controlled from an operators console (60) by means of the wire line (61) extended from a drilling apparatus or derrick line reel (62) through the crown blocks (63) at the top of the derrick to the traveling blocks (64) and the connector and elevator links connected to the polished rod (26).

Hydraulic tubing, which is suitable for the operation, is for example HS-70-CM continuously milled A-606 type 4 alloy steel with an internal yield of 11,400 PSIG. The grade of tubing depends on the operation to be performed, i.e., the amount of tubing elasticity required and the amount of fluid pressure to be created to form the drain hole.

In use the tube bending tool (30) and the anchor (14) are attached at the lower end of the work string or pipe (13) elements. The work string is lifted six inches and rotated one half turn after lowering to the proper depth in the well (10) to unjay the tube anchor (14). This action releases the slip segments (19) to engage the inside wall of the well casing (11) above the milled section or cavity (16) through which the piston (20) will penetrate the formation (13). The work string (29) is then packed off and flanged onto the wellhead at the surface.

When the piston (20) bores into the formation (12) to the length of the fluid tubing (40), the crossover element (21) descends into the tube bending tool (30) as the stop ring (23) seats in the top of the cap (36). This essentially closes off the holes (22) and shuts off the circulation at the fluid pressure pump resulting in relief of the suspended weight of the string (27), which is indicated on a gauge at the surface. These events indicate to the operator that the piston (20) is fully extended.

Once the piston (20) motion is stopped the operator ceases applying weight to the string (27) and shuts of the fluid pressure pump. The string (27) is elevated a few feet and the cuttings are circulated out of the well (10). The pressure pump is again stopped and fluid pressure is allowed to equalize. Using the drilling apparatus the piston (20) and string (27) are withdrawn form the well (10). The used piston (20) is discarded and a new one attached. The wellhead is then unflanged and rotated to change the azimuth such that the next bore is performed at a radial distance from previous drain holes (17).

Referring to FIGS. 1 through 9, the tube bending tool (30) has an attachment element (31) and bending element (38) attached by for example welding. The attachment element (31) is threaded at its upper end (32) for engagement with pipe (13) or anchor (14). Channel (33) is formed to allow the passing through of fluid tube (40). A seal (34) or poly-pac ring is retained in seal cavity (35) for purposes of sealing the tube bending tool (30) to prevent transfer of fluid around the outside of pipe (13). This seal (34) may be compressed by threadably engaging cap (36) with the upper end (32). The cap (36) may be beveled (45) at its top end to reduce the likelihood of bending tubing (40) as it is inserted. The attachment element (31) is formed with flats (37) to reduce the weight of the tube bending tool (30).

The bending element (38) has a hook shaped bending channel (39) formed therein. As a pipe (13) is passed through bending channel (39) the pipe (13) is redirected to exit laterally from the longitudinal axis of the bending element (38). Bending element (38) has flats (37) for weight reduction. While an evenly split bending element (38) has been illustrated as the preferred embodiment, other configurations are possible. One such configuration could be to form the attachment element (31) with a portion of the bending element (38). Channel (33) and approximately one half of the bending channel (39) would be fabricated as one element. The second element would comprise the remainder of the bending element (38) and bending channel (39). These two elements would then be attached by welding, use of fasteners such as bolts or like means. The emphasis in forming two elements to mate together is to initially provide access for ease in fabricating the bending channel (39).

It has been determined that for use of a 1.00 inch outside diameter fluid tube (40) that a channel (33) and bending channel (39) of inside diameter 1.123 inches with a surface finish of 62 microns will provide proper tolerance to bend the fluid tube (40). This tolerance with the proper wall thickness and elasticity of metal fluid tubing (40) gives the best results. The inside wall of the bending channel (39) may be treated with a low friction material such as moly di-sulfide. The bending channel (39) general dimensions for this configuration are approximately an 18 inch length as measured along the center line (50) of the bending element (38) and in the preferred embodiment with an approximately 7 inch straight portion thereof. The bend from the center line (50) is 5 to 6 inches to the generally circular portion (51), which has a radius of 4 to 6 inches.

To manufacture the bending channel (39) the bending element (38) is normally formed as two halves to allow milling of the bending channel (39) and then the two halves are attached by for example welding. Non-heat treated leaded alloy steel of grade 4140, which allows proper milling, and welding produces a suitable tube bending tool (30) for slidably passing a fluid tube (40) therethrough.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for redirecting fluid tubing in a well from a generally vertical direction to a generally horizontal direction comprising:

a tube bending tool having a means for attachment to a pipe;

the tube bending tool having a bending channel therein that is a general fish hook shape having a straight channel portion transitioning to a first bend from a center line, then transitioning to a generally circular portion curving counter direction to the first bend to exit laterally from the bending element; and the bending channel having an inside diameter tolerance of approximately 12% for insertability of a fluid tube outside diameter.

2. The device as in claim 1 wherein the tube bending tool is comprised of an attachment element attached to a bending element with the attachment element having a means for attachment to a pipe.

3. The device as in claim 2 wherein the bending element is formed of two parts with a portion of the bending channel in each part and the two parts are attached one to the other.

4. The device as in claim 2 wherein the attachment element at an upper end being threaded externally.

5. The device as in claim 2 wherein the attachment element having a seal cavity formed therein with a seal retained in the seal cavity and a cap having a channel therein threadably engaged internally to the attachment element to compress the seal.

6. The device as in claim 5 wherein the cap at an upper end having a beveled channel wall end.

7. The device as in claim 1 wherein the tube bending tool has a flat surface on an outer side.

8. The device as in claim 1 wherein the bending channel is machined to approximately 62 micro finish.

9. The device as in claim 1 wherein the tube bending tool is formed of non heat treaded leaded alloy steel.

10. The device as in claim 9 wherein the steel is of grade 4140.

11. The device as in claim 2 wherein the bending channel for a 25 inch length bending element is approximately 18 inches in the longitudinal dimension with a first bend from a center line at approximately 7 inches transitioning to a generally circular portion of radius approximately 4 to 6 inches to exit laterally from the bending element.

12. A method of producing a plurality of radial bore holes laterally from a generally vertical well comprising the steps of:

a) attaching a tube bending device to the end of a well pipe;

b) lowering the tube bending device to the desired level within a well casing;

c) securing the bending device at the level by a means for attachment;

d) slideably inserting a fluid tube into the tube bending device at the upper end;

e) applying a cutting fluid under pressure into the well pipe and the fluid tube which fluid exits through a nozzle at the end of the fluid tube; and f) stopping the sliding movement of the fluid tube with a means for stopping.

13. The method as in claim 12 further comprising the step of:

a) monitoring a suspension weight of a connecting rod string at the well head to determine when a radial bore hole is complete; and b) removing the fluid tube by means for removal.

14. The method as in claim 12 wherein the cutting fluid is introduced into the fluid tube through a crossover element attached to the fluid tube.

15. The method as in claim 12 wherein the means for attachment is an anchor attached to the pipe.

16. The method as in claim 13 wherein the means for stopping is the connecting rod string with a stop ring to engage a cap in the tube bending tool.

17. The method as in claim 13 wherein the means for removal is extraction of the connecting rod string attached to the fluid tube.

18. The method as in claim 12 further comprising the step of:

milling the well casing at the desired depth to form an open cavity in the well prior to lowering the tube bending device.

19. The method as in claim 18 further comprising the step of:

filtering and removing the debris from the cavity prior to lowering the tube bending device.

20. The method as in claim 12 further comprising the step of:

slidably inserting the end of a fluid tube with nozzle into the tube bending device prior to lowering.

21. The method as in claim 13 further comprising the steps of:

a) unsecuring the tube bending device and rotating radially to a new drilling position;

b) securing the tube bending device;

c) slidably inserting another fluid tube into the tube bending device and simultaneously circulating a cutting fluid;

d) stopping the sliding movement of the fluid tube; and e) removing the fluid tube.

22. The method as in claim 21 repeated to drill a plurality of radial bore holes.

* * * * *